US008714869B1

(12) United States Patent
Ries et al.

(10) Patent No.: US 8,714,869 B1
(45) Date of Patent: May 6, 2014

(54) COMPACTOR HAVING ELECTRONICALLY CONTROLLED HEATING ELEMENT

(71) Applicants: Michael W. Ries, Coon Rapids, MN (US); Matthew S. Frantz, Shakopee, MN (US); Jon M. Scharf, Maple Grove, MN (US); Paul D. Weiss, Andover, MN (US)

(72) Inventors: Michael W. Ries, Coon Rapids, MN (US); Matthew S. Frantz, Shakopee, MN (US); Jon M. Scharf, Maple Grove, MN (US); Paul D. Weiss, Andover, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/693,083

(22) Filed: Dec. 4, 2012

(51) Int. Cl.
*E01C 23/07* (2006.01)

(52) U.S. Cl.
USPC ..... 404/79; 404/77; 404/84.05; 404/95; 219/202

(58) Field of Classification Search
USPC ..... 404/84.05, 122, 77, 79, 95; 219/202
See application file for complete search history.

(56) References Cited

U.S. PATENT DOCUMENTS

| | | | | |
|---|---|---|---|---|
| 2,930,500 | A | 3/1960 | Ellis | |
| 2,990,755 | A | 7/1961 | Caufield | |
| 3,007,379 | A | 11/1961 | Ellis | |
| 3,066,585 | A * | 12/1962 | Cumpton | 404/95 |
| 3,068,765 | A | 12/1962 | Caufield | |
| 3,080,800 | A | 3/1963 | Malzahn | |
| 3,120,159 | A | 2/1964 | White | |
| 3,331,297 | A | 7/1967 | Bettino | |
| 3,595,145 | A | 7/1971 | Mozdzanowski | |
| 4,009,967 | A | 3/1977 | Layton | |
| 4,157,877 | A * | 6/1979 | Lee | 404/128 |
| 4,182,444 | A | 1/1980 | Fisher | |
| 4,313,691 | A | 2/1982 | Yargici | |
| 4,493,585 | A | 1/1985 | Axer | |
| 4,737,050 | A | 4/1988 | Halim | |
| 4,861,187 | A | 8/1989 | Sinkkonen | |
| 5,062,738 | A | 11/1991 | Owens | |
| 5,088,855 | A * | 2/1992 | Giliberti | 404/103 |
| 5,298,722 | A | 3/1994 | Tanaka | |
| 5,348,418 | A | 9/1994 | Campbell | |
| 5,417,516 | A | 5/1995 | Birtchet | |
| 6,236,923 | B1 | 5/2001 | Corcoran et al. | |
| 6,318,928 | B1 | 11/2001 | Swearingen | |
| 6,350,963 | B1 * | 2/2002 | Gray | 219/202 |
| 6,514,007 | B2 | 2/2003 | Richter | |
| 6,561,729 | B1 | 5/2003 | Potts | |
| 6,698,974 | B2 | 3/2004 | Codina et al. | |
| 6,749,364 | B1 | 6/2004 | Baker et al. | |
| 7,985,022 | B2 * | 7/2011 | Azuma et al. | 374/176 |
| 8,443,852 | B2 | 5/2013 | McCaughey | |
| 2003/0108389 | A1 | 6/2003 | Codina et al. | |
| 2005/0099283 | A1 * | 5/2005 | Johnson et al. | 340/447 |
| 2007/0071552 | A1 | 3/2007 | Velsor | |
| 2008/0292401 | A1 | 11/2008 | Potts | |

FOREIGN PATENT DOCUMENTS

| | | |
|---|---|---|
| GB | 1260932 | 1/1972 |
| JP | 04402639 | 1/2010 |
| JP | 2010188927 | 9/2010 |
| JP | 2012096644 | 5/2012 |

* cited by examiner

*Primary Examiner* — Raymond W Addie
(74) *Attorney, Agent, or Firm* — Andrew A. Phillips

(57) ABSTRACT

A pneumatic compactor includes a frame and a compacting member rotatably coupled to the frame and configured to rotate in contact with a substrate of paving material. The compacting member is a tire. The compactor further includes a heating element located within the compacting member, a sensor thermally coupled to the heating element, and an electronic control module. The electronic control module is in communication with the heating element and the sensor and is configured to energize the heating element.

20 Claims, 3 Drawing Sheets

COMPACTOR HAVING ELECTRONICALLY CONTROLLED HEATING ELEMENT

TECHNICAL FIELD

The present disclosure relates generally to heating a rotatable compacting member of a machine, and relates more particularly to heating a tire of a pneumatic compactor.

BACKGROUND

Compactor machines, also variously called compactors and compaction machines, are frequently employed for compacting dirt, gravel, asphalt, and other compactable surfaces associated with roadbeds and other land areas. One such type of compaction machine is a drum-type compactor having one or more drums adapted to compact the particular surface over which the compactor is being driven. In order to compact the surface, the drum-type compactor may include a drum assembly having a vibratory mechanism that includes inner and outer eccentric weights arranged on rotatable shafts situated within the drum. Both amplitude and frequency of vibration may be controlled to establish degree of compaction.

Another type of compactor machine is a pneumatic wheel roller-style of compactor, which is dependent upon tire pressure for achieving effective compaction. For successful operation of the pneumatic compactor, the ground contact pressures should be managed in accordance with compaction surface type. Typically, an operator estimates a contact pressure based upon weight of the machine, air pressure of the tires, and compaction conditions in accordance with a chart provided by the machine manufacturer. Overall weight of the machine may be controlled by adding ballast such as sand and/or water, according to a specific ground compaction task.

Paving material is typically comprised of viscous hydrocarbons, and gravel or the like. The paving material is deposited at a relatively high temperature, and cools to harden into a finished product. It is well known that the hot, viscous hydrocarbon constituents of paving material can stick to machinery. Where paving material sticks to ground contacting parts of the machinery, such as the rotating drums or tires of compactors, the quality of the paving material mat can suffer, and continued operation of the machinery can itself be compromised. This problem is especially noted when the drums or tires of compactors are not at temperature. For example, if a pneumatic compactor is not warmed-up (i.e., operated) off-site, the tires are too cool and asphalt will stick to the tires. Having to warm up the compactor off-site is inefficient and costly.

Systems are available for pneumatic compactors to minimize the need for off-site operation. One method is to spray water or an emulsion onto the tires. Various on-board spray systems configured to spray water, release agents, and the like, onto rotating compacting members are used to prevent the paving material from adhering. For pneumatic compactors, it is typically unnecessary to continuously spray the tires to prevent sticking of the paving material, and thus the operator is often given control over the spray system to apply the liquid at his or her discretion. An example of this type of system is found in U.S. patent application Ser. No. 13/467,433. It is also known to install heaters on the pneumatic compactor above the tires to pre-heat them. Both of heating and spray systems involve adding external components to the compactor and added cost.

SUMMARY

In one aspect, a pneumatic compactor includes a frame and a compacting member rotatably coupled to the frame and configured to rotate in contact with a substrate of paving material. The compacting member is a tire. The compactor further includes a heating element located within the compacting member, a sensor thermally coupled to the heating element, and an electronic control module. The electronic control module is in communication with the heating element and the sensor and is configured to energize the heating element.

In another aspect, a system for heating a tire in a pneumatic compactor includes a heating element, a sensor for monitoring a temperature, and an electronic control module in communication with the heating element and the sensor. The electronic control module is configured to receive a signal from the sensor indicative of the temperature and to control a thermal output of the heating element based on the temperature.

In another aspect, a method for heating a tire of a pneumatic compactor includes receiving a temperature representative of the compacting member, comparing the temperature to a minimum temperature, and raising the temperature above the minimum temperature, if the temperature is below the minimum temperature.

DETAILED DESCRIPTION

Figure 1:
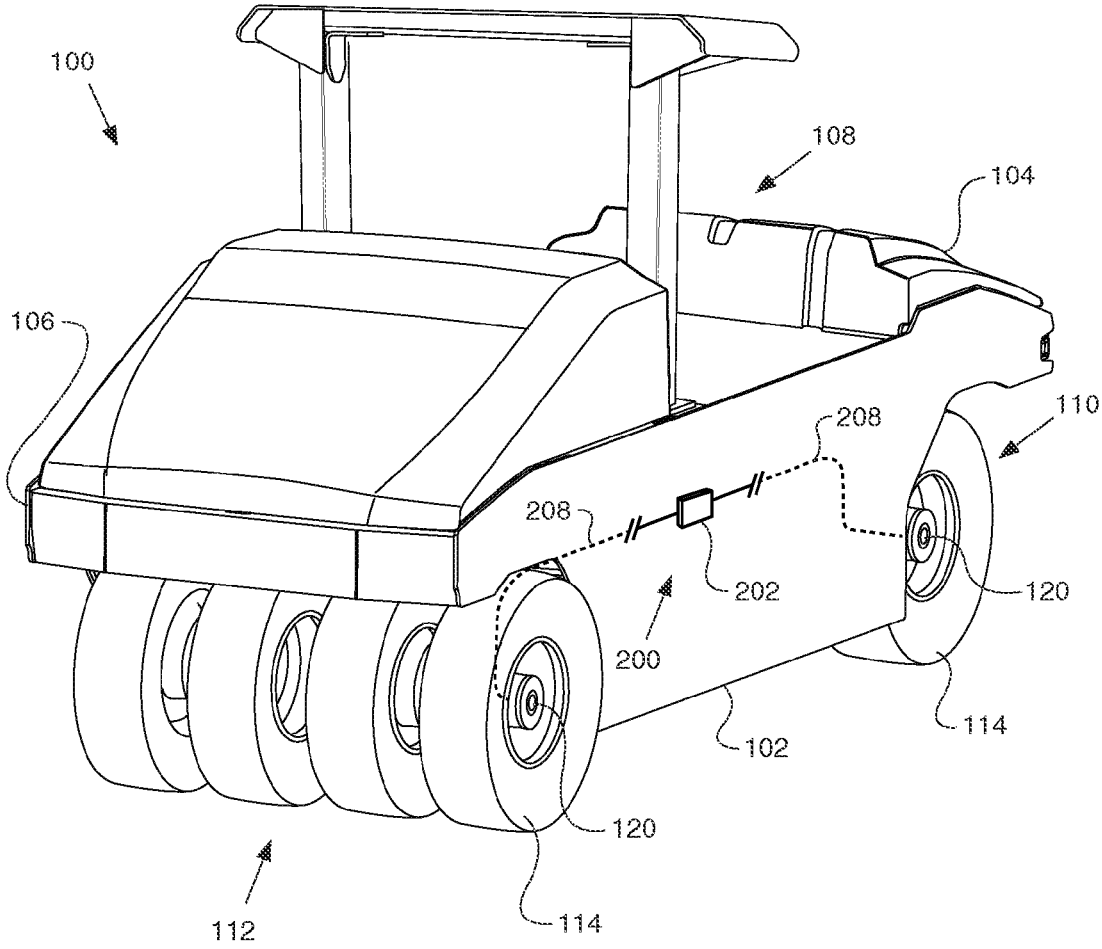
FIG. 1 is a diagrammatic view of a compactor according to one embodiment.

Referring to FIG. 1, machine 100, shown as a pneumatic compactor, includes a frame 102 having a front frame end 104 and a back frame end 106. An operator control station 108 is coupled to frame 102 between front frame end 104 and back frame end 106 in a conventional manner. Machine 100 further includes a front compacting member 110 and a rear compacting member 112. Both front compacting member 110 and rear compacting member 112 are rotatably coupled to frame 102. In the embodiment shown in FIG. 1, both front compacting member 110 and rear compacting member 112 are each made up of four pneumatic tires 114.

One of skill in the art will appreciate that machine 100 could be any type of compactor employing tires 114. And while front compacting member 110 and rear compacting member 112 are described as having four pneumatic tires 114, front compacting member 110 and rear compacting member 112 could have any number of tires 114, and front compacting member 110 may have a different number of tires 114 than are present in rear compacting member 112.

Machine 100 further includes a heating system 200. Heating system 200 will be more fully described with respect to FIG. 2, but is intended to heat front and rear compacting members 110, 112 to an appropriate temperature so that when machine 100 is operated, paving material is less likely to stick to front and rear compacting members 110, 112. Heating system 200 generates its own heat and does not rely on the operation of machine 100 to generate heat (i.e., machine 100 does not need to have its engine on to generate heat). Heating system 200 will generate heat regardless of the operating condition of machine 100.

Figure 2:
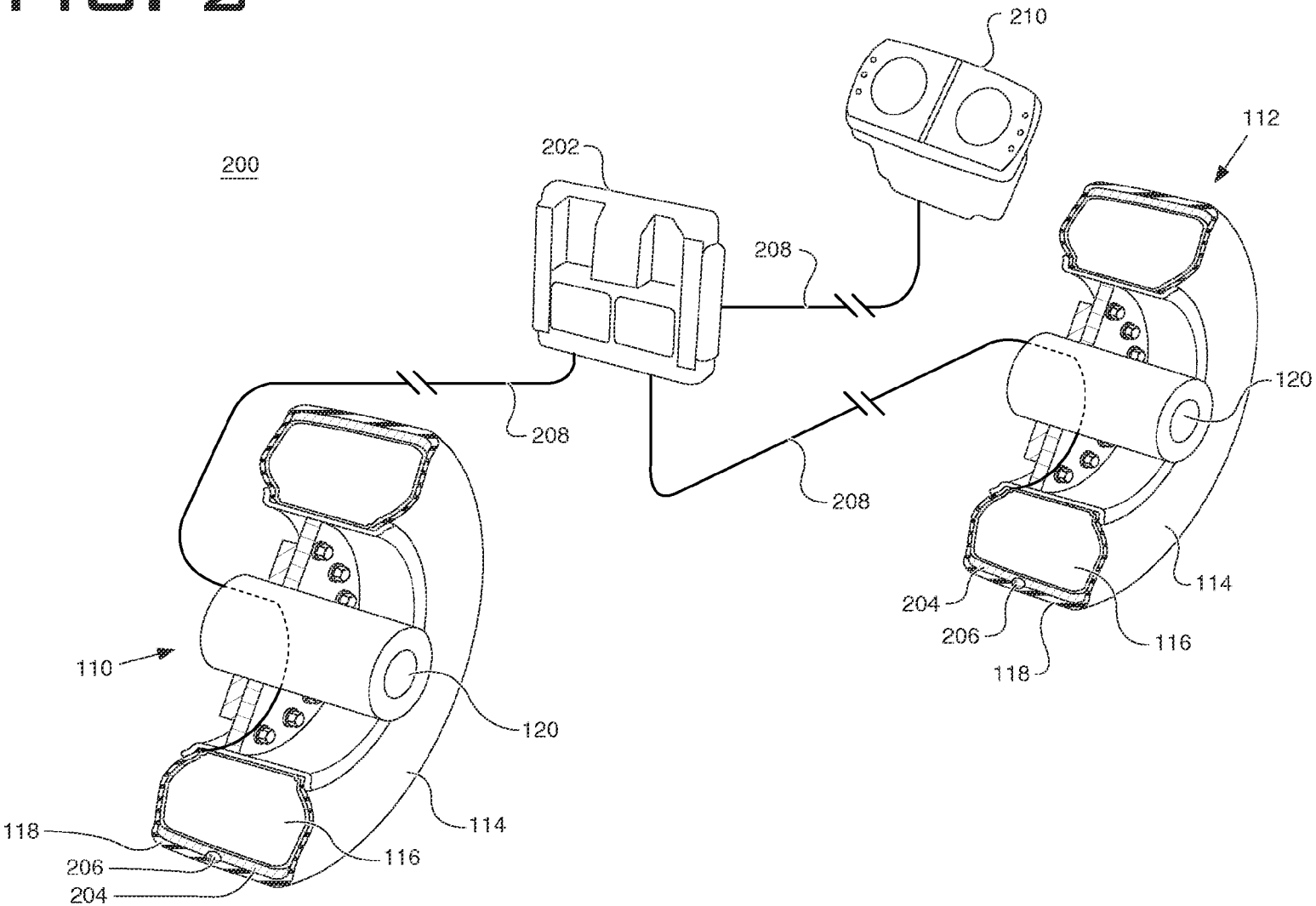
FIG. 2 is a diagrammatic view of a system for minimizing sticking of paving material to a compacting member in a compactor, according to one embodiment.

Referring now to FIG. 2, heating system 200 includes one or more heating elements 204, one or more sensors 206, one or more switches 210, and one or more electronic control modules 202 for controlling the temperature of the tires 114. FIG. 2 shows a cut away view of tire 114 from front compacting member 110 and tire 114 from rear compacting member 112. Tires 114 from front compacting member 110 are connected by a wire 208 or wires 208 to electronic control module 202, and tires 114 from rear compacting member 112 are connected to electronic control module 202 by a separate wire 208 or separate wires 208. Tire 114 from front compacting member 110 and tire 114 from rear compacting member 112 have the same characteristics, so reference will only be made to tire 114.

Tire 114 is rotatably coupled to an axle 120. Tire 114 has an inner tube 116, an outer surface 118, and an inner surface where inner tube 116 comes in contact with tire 114. Inner tube 116 is filled with compressed air. Outer surface 118 is the part of tire 114 that comes into contact with the paving material. While the present disclosure is described with tire 114 having inner tube 116, tire 114 need not have inner tube 116.

Between inner tube 116 and outer surface 118 is heating element 204. Heating element 204 can be any device, well known in the art, that converts electricity to heat. Heating element 204 has an infinite number of energized settings, from deenergized to fully energized. Heating element 204 extends all the way around the inner surface of tire 114 so that tire 114 is uniformly heated. Sensor 206 is thermally coupled to heating element 204 such that it can measure the temperature of heating element 204 or outer surface 118 of tire 114. Sensor 206 is any device for monitoring temperature known in the art.

Heating element 204 and sensor 206 are in communication with electronic control module 202. Electronic control module 202 is also in communication with switch 210 located in operator control station 108. While the present disclosure contemplates only a single electronic control module 202, in practice, multiple electronic control modules 202 may be used. In FIG. 2, electronic control module 202, heating element 204, sensor 206, and switch 210 are in communication by wire 208. Wire 208 communicates temperature data from sensor 206 to the electronic control module 202. Wire 208 also supplies electrical energy to heating element 204 through a fuse box (not illustrated) enabling it to reach an energized setting or thermal output as controlled by electronic control module 202.

In alternative embodiments, one or more electronic control modules 202, one or more heating elements 204, one or more sensors 206, and one or more switches 210 may communicate wirelessly with each other. Heating element 204 may also receive electrical energy from a power module located in tire 114, or on a portion of machine 100 closer to tire 114, to minimize the amount of wire 208 needed. It is also contemplated that multiple wires 208 may be needed. For example, one wire 208 to carry data from sensor 206 to electronic control module 202 and a second wire 208 to carry electrical power to heating element 204. Additionally, a separate wire 208 may go to each tire 114. It is also possible that tires 114 in front compacting member 110 and tires 114 in rear compacting member 112 are on a different electrical circuit, so that electrical power is supplied to each through separate sources. A combination of wired and wireless communication is contemplated as well.

Operator switch 210 is located in operator control station 108. Operator switch 210 is shown as a simple toggle switch, but may also be a keypad or touch screen. In alternative embodiments where switch 210 is a keypad or a touch screen, the operator would be able to monitor the temperature provided by sensor 206 and input a temperature at which heating system 200 would maintain tire 114. Switch 210 enables the operator to activate heating system 200 which starts electronic control module 202. In the first setting, heating system 200 is off. In the second setting, heating system 200 is on as will be further described below.

Sensor 206 monitors a temperature representative of tire 114. That temperature may be the temperature of the inner surface of tire 114, outer surface 118, the heating element 204, or any other point in tire 114 that provides a proper representation of the temperature of tire 114. Sensor 206 may be located at a single point within tire 114 or it could be located at multiple points within tire 114. The temperature at which the paving material will not adhere to tire 114 is known, and it is anticipated that a minimum temperature above the known temperature will be set in electronic control module 202. Electronic control module 202 will compare the temperature communicated from sensor 206 to the minimum temperature. Electronic control module 202 will then determine what the energized setting of heating element 204 needs to be to control the temperature above the minimum temperature. The temperature data from sensor 206 is continuously fed to electronic control module 202, enabling electronic control module 202 to continuously alter the energized setting of heating element 204 so that heating system 200 achieves a steady-state temperature for tire 114. While sensor 206 is described as being integrated with heating element 204, it need not be. Sensor 206 may be positioned anywhere within tire 114 that best enables it to gauge the temperature.

INDUSTRIAL APPLICABILITY

In general, the present disclosure may prove particularly useful for pneumatic compactor machines. It may also be useful for other industrial machines, including but not limited to certain loaders and various work machines used in construction, agriculture, and industrial environments.

Figure 3:
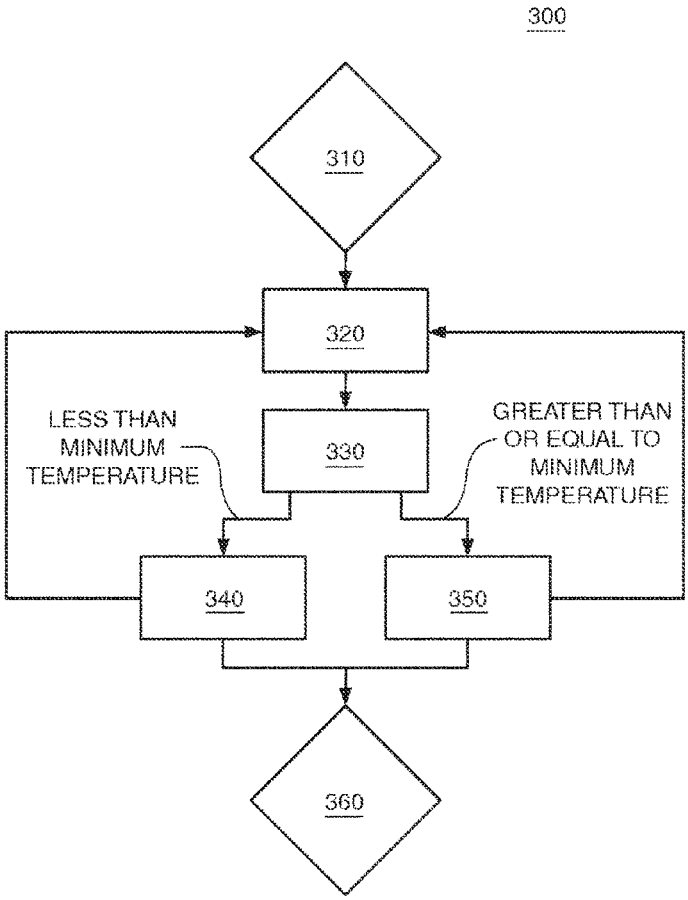
FIG. 3 is a flowchart illustrating an example control process according to the present disclosure.

Referring now also to FIG. 3, there is shown a flowchart 300 illustrating an example control process according to the present disclosure used with machine 100. The process of flowchart 300 starts at step 310 when the operator activates the heating system 200. The process advances to step 320, where upon activation of heating system 200, electronic control module 202 receives a temperature from sensor 206. In step 330, electronic control module 202 compares the temperature received from sensor 206 to the minimum temperature set in heating system 200 or, alternatively, the minimum temperature set by the operator. If the comparison by electronic control module 202 of the temperature to the minimum temperature shows that the temperature is less than the minimum temperature, the process proceeds to step 340. At step 340, the electronic control module energizes heating element 204 to raise the temperature. After step 340, the process returns to step 320 where electronic control module 202 receives a new temperature reading from sensor 206. At step 330, the new temperature is compared to the minimum temperature, and if the new temperature is still below the minimum temperature, the process again proceeds to step 340. That process will repeat until at step 330, the new temperature reading is above the minimum temperature.

At that point, the process proceeds to step 350, where electronic control module 202 will select an energized setting of heating element 204 to maintain the temperature at or above the minimum temperature. From step 350, the process will repeat through steps 320 and 330. It is desirable that electronic control module 202 regularly receive temperature data from sensor 206, to ensure that the proper energized setting of heating element 204 is in use. If the temperature falls below the minimum temperature, there is a risk that paving material will stick to tires 114. If the temperature rises too high above the minimum temperature, tires 114 could be damaged and it would be an inefficient use of the energy of machine 100 to operate heating element 204 at a high energized setting that is unnecessary. It is anticipated that electronic control module 202 would maintain temperature within a band above the minimum temperature, but not high enough to be inefficient and a waste of electrical power, and could cause potential damage to tire 114. A maximum temperature is also known where damage to tire 114 may begin to occur. The temperature band should be set so temperature will not approach that maximum temperature. One of skill in the art will appreciate that there are multiple ways this temperature band will be determined and set. The process repeats through steps 320, 330, 340, and/or 350 (as previously described), until the operator deactivates the process at step 360 by turning heating system 200 off with switch 210.

This method eliminates the need for the installation of external components on machine 100, which could be damaged during normal operation of machine 100. And unlike heaters that are placed on the body of machine 100, this method controls the temperature of tires 114 so as to not overheat them. This method also eliminates the need to warm machine 100 up off-site prior to bringing it on-site, because heating system 200 will bring tires 114 up above the minimum temperature without having to operate machine 100, saving fuel and labor costs. This method also reduces electrical consumption since sensor 206 controls the energized setting of heating element 204, so that heating element 204 does not consume more power than is necessary to maintain the temperature of tires 114 above the minimum temperature.

The present disclosure has described a heating system 200 where sensor 206 takes a single temperature reading of tire 114 at a single point in time, which is then repeated. Heating system 200 is in use for all tires 114 on machine 100. It will be appreciated by those skilled in the art that the time of the repetition can vary from temperature readings being taken at short intervals (e.g., on a continuous basis, such as less than 0.1 seconds) to longer intervals (e.g., greater than 10 minutes). The frequency of temperature readings will be determined to optimize the efficient use of electrical power in combination with the performance of heating element 204, and may change based on various operating conditions. It will also be appreciated by those skilled in the art that temperature readings may be taken at multiple points, for example, by placing multiple sensors 206 on tire 114 or a single sensor 206 that reads temperature at multiple locations of tire 114. Again, the placement of a sensor 206 or sensors 206 will be determined to optimize the efficient use of electrical power in combination with the performance of heating element 204, and may change based on various operating conditions.

It will be appreciated by those skilled in the art that actual performance of machine 100 will vary as a function of the inflation pressure of tires 114 and the softness or hardness of the surface being compacted. Thus, low tire inflation pressures will generally improve fraction and durability of a compactor machine on softer ground, for example, while higher tire inflation pressures will provide more efficient results on firmer surfaces. To the extent that the compaction surface may be softer and of lower density in early stages of the compaction process, the surface will generally become increasingly denser and hence more firm after several passes of the compactor machine over the surface. As such, it may be advantageous to vary the tire inflation pressure as a function of real-time density of the compaction surface.

Changes in temperature will cause corresponding changes to pressure of tires 114. It is contemplated that the present disclosure may be combined with an automated pressure monitoring system, such as the one disclosed in U.S. patent application Ser. No. 13/278,870, the contents of which are incorporated herein by reference. Accordingly, operators of machine 100 would be able to automatically control the temperature of tires 114 as well as the pressure of tires 114 to prevent paving material from sticking to tires 114 and maintaining tires 114 at the proper pressure to accomplish machine 100's task.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A pneumatic compactor comprising:

a frame;

a compacting member rotatably coupled to the frame and configured to rotate in contact with a substrate of paving material, wherein the compacting member is a tire;

a heating element, the heating demerit located within the tire;

a sensor thermally coupled to the heating element; and an electronic control module in communication with the heating element and the sensor, and configured to energize the heating element, and further configured to maintain the temperature of the compacting member between 130 and 260 degrees Fahrenheit.

2. The pneumatic compactor of claim 1 wherein the tire has an inner tube, and an inner surface; and the heating element is located between the inner tube and the inner surface.

3. The pneumatic compactor of claim 2 wherein the heating element has an energized setting selected from a range of not energized to fully energized.

4. The pneumatic compactor of claim 3 wherein the sensor communicates a signal to the electronic control module indicative of a temperature, and the electronic control module controls the energized setting based on the signal received from the sensor.

5. The pneumatic compactor of claim 4 wherein the electronic control module controls the energized setting to raise the temperature above a minimum temperature.

6. The pneumatic compactor of claim 5 wherein the electronic control module controls the energized setting to maintain the temperature above the minimum temperature.

7. The pneumatic compactor of claim 6 wherein the electronic control module is electronically coupled to the heating element through a wire.

8. The pneumatic compactor of claim 7 wherein the sensor monitors the temperature of the heating element.

9. The pneumatic compactor of claim 8 wherein the heating element extends around an entire circumference of the inner surface.

10. A system for heating a tire in a pneumatic compactor comprising;

a heating element;

a sensor for monitoring a temperature; and an electronic control module in communication with the heating element and the sensor, the electronic control module being configured to:

receive a signal from the sensor indicative of the temperature; and control a thermal output of the heating element based on the temperature to maintain the temperature of the tire between 130 and 260 degrees Fahrenheit.

11. The system of claim 10 wherein the heating element is located within the tire.

12. The system of claim 11 wherein the thermal output is selected from a range of no thermal output to maximum thermal output.

13. The system of claim 12 wherein the sensor is integrated with the heating element.

14. The system of claim 12 wherein the electronic control module is further configured to compare the temperature to a minimum temperature.

15. The system of claim 14 wherein the electronic control module controls the thermal output to raise the temperature above the minimum temperature.

16. The system of claim 15 wherein the electronic control module controls the thermal output to maintain the temperature above the minimum temperature.

17. The system of claim 16 wherein the electronic control module communicates wirelessly with the sensor.

18. The system of claim 17 wherein the electronic control module communicates wirelessly with the heating element.

19. A method for heating a tire of a pneumatic compactor, the method comprising the steps of:

receiving a temperature representative of the tire;

comparing the temperature to a minimum temperature, wherein the minimum temperature is at least 130 degrees Fahrenheit; and raising the temperature above the minimum temperature, if the temperature is below the minimum temperature.

20. The method of claim 19 further comprising maintaining the temperature at or above the minimum temperature, after the temperature has been raised above the minimum temperature.

* * * * *

UNITED STATES PATENT AND TRADEMARK OFFICE

CERTIFICATE OF CORRECTION

PATENT NO. : 8,714,869 B1
APPLICATION NO. : 13/693083
DATED : May 6, 2014
INVENTOR(S) : Ries et al.

It is certified that error appears in the above-identified patent and that said Letters Patent is hereby corrected as shown below:

In the Claims

Column 6, line 28, in Claim 1, delete “demerit” and insert -- element --.

Column 6, line 62, in Claim 10, delete “comprising;” and insert -- comprising: --.

Signed and Sealed this
Fifteenth Day of September, 2015

Michelle K. Lee

Michelle K. Lee
*Director of the United States Patent and Trademark Office*